US005439145A

United States Patent [19]

Salkeld et al.

[11] Patent Number: 5,439,145

[45] Date of Patent: * Aug. 8, 1995

[54] APPARATUS FOR DISPENSING LIQUID FROM AN INVERTED CONTAINER

[75] Inventors: Paul Salkeld, Redditch; Andrew Gibbs, Leamington Spa; Robert Tansley, Stratford-Upon-Avon, all of England

[73] Assignee: EBAC Limited, United Kingdom

[ * ] Notice: The portion of the term of this patent subsequent to Nov. 8, 2011 has been disclaimed.

[21] Appl. No.: 267,502

[22] Filed: Jun. 29, 1994

Related U.S. Application Data

[63] Continuation-in-part of Ser. No. 96,254, Jul. 26, 1993, Pat. No. 5,361,942, and Ser. No. 96,255, Jul. 26, 1993, abandoned.

[51] Int. Cl.[6] ..... B67D 5/58

[52] U.S. Cl. ..... 222/189.09; 222/214; 222/481; 251/9

[58] Field of Search ..... 222/88, 83.5, 105, 129, 222/214, 129.1, 146.1, 146.6, 132, 479, 481, 108, 189; 62/390; 141/18, 330, 382, 364, 386; 251/7, 9

[56] References Cited

U.S. PATENT DOCUMENTS

| | | | |
|---|---|---|---|
| 4,332,333 | 6/1982 | Linsey | 222/479 X |
| 4,450,987 | 5/1984 | Boettcher et al. | 222/105 X |
| 4,557,399 | 12/1985 | Redick, Jr. | 222/83.5 X |
| 4,699,188 | 10/1987 | Baker et al. | 141/18 |
| 4,958,747 | 9/1990 | Sheets | 222/129 X |

FOREIGN PATENT DOCUMENTS 9003919 4/1990 WIPO .

*Primary Examiner*—Gregory L. Huson
*Attorney, Agent, or Firm*—Ira S. Dorman

[57] ABSTRACT

A water dispenser which dispenses liquid from an inverted bottle includes a housing 31 provided with a mounting arrangement for the bottle. A feed tube incorporated in a removably mounted manifold body is positioned to project into the neck of the bottle to conduct water to a reservoir from which water is discharged through a valve 80. The valve includes a pinch bar 106 acting on a flexible plastics or rubber tube 96 which can easily be replaced. The outlet end of the tube is recessed behind the housing 31 to prevent accidental hand contact. Liquid discharged from the bottle is replaced by air which passes through a one-way float valve mounted on the manifold body for removal therewith, and the float valve incorporates an air filter.

7 Claims, 6 Drawing Sheets

APPARATUS FOR DISPENSING LIQUID FROM AN INVERTED CONTAINER

CROSS REFERENCE TO RELATED APPLICATIONS

This application is a continuation-in-part of applications Ser. Nos. 08/096,254 and 08/096,255, both filed 26 Jul. 1993. Application Ser. No. 08/096,254 issued as U.S. Pat. No. 5,361,942 on Nov. 8, 1994, and application Ser. No. 08/096,255 is now abandoned.

TECHNICAL FIELD OF THE INVENTION

This invention relates to liquid dispensers such as bottled water dispensers.

BACKGROUND

Bottled water dispensers are usually arranged to receive the neck of an inverted bottle filled with clean water. Sometimes, as in U.S. Pat. No. 4,699,188 and WO 90/03919 for example, the bottle is provided with a cap through which a feed tube is inserted to discharge the water from the bottle into one or more reservoirs inside the dispenser. The water in the respective reservoir may then be heated, cooled or carbonated for example, from whence the water can be drawn via a discharge valve.

There is currently a requirement to maintain strict hygiene in water dispensers. In the majority of water dispensers the reservoir and other components which come into contact with the water are sterilised in situ. This is a difficult task which is not always carried out as thoroughly as it should be.

Considering the discharge valve in particular, this can pose a potential source of contamination since the valve outlet is often disposed in a position which allows direct hand contact by users. Removal of the valves for sterilisation would be a time-consuming operation.

An aim of the present invention may be viewed as being to improve the hygiene of such dispensers.

SUMMARY OF THE INVENTION

The present invention proposes liquid dispensing apparatus for dispensing liquid from an inverted container having a neck through which the liquid is discharged, the apparatus comprising:

- a housing provided with a mounting arrangement for receiving and supporting an inverted container thereon, said mounting arrangement defining an opening for receiving the container neck;
- a body which includes a feed tube for insertion into the neck of the liquid container to conduct liquid therefrom;
- mounting means within said housing for releasably holding said body, said mounting means being arranged to positively support said body within said housing and below said opening such that said feed tube projects upwardly to a level adjacent said opening for being received in the neck of the container, said body being releasably held by said mounting means;
- conduit means connected for conducting liquid from said feed tube, said conduit means comprising a flexible tube; and
- a discharge valve for controlling the discharge of water from the container, the discharge valve comprising a pinch valve which is arranged to act said flexible tube, said body and conduit means including said flexible tube thereby being removable for replacement during a maintenance operation whilst said pinch valve remains in situ.

With this form of valve there are no components in contact with the liquid which need to be sterilised except for the tube which is easily removed and replaced. The tube could be sterilised for re-use, although since it is a relatively inexpensive item the tube will often be discarded.

In order to reduce still further the risk of contamination of the discharge valve, the tube preferably terminates in a discharge outlet which is shrouded by a cover to prevent direct hand contact with the outlet.

BRIEF DESCRIPTION OF THE DRAWINGS

The following description and the accompanying drawings referred to therein are included by way of non-limiting example in order to illustrate how the invention may be put into practice. In the drawings.

DETAILED DESCRIPTION OF THE DRAWINGS

Figure 1:
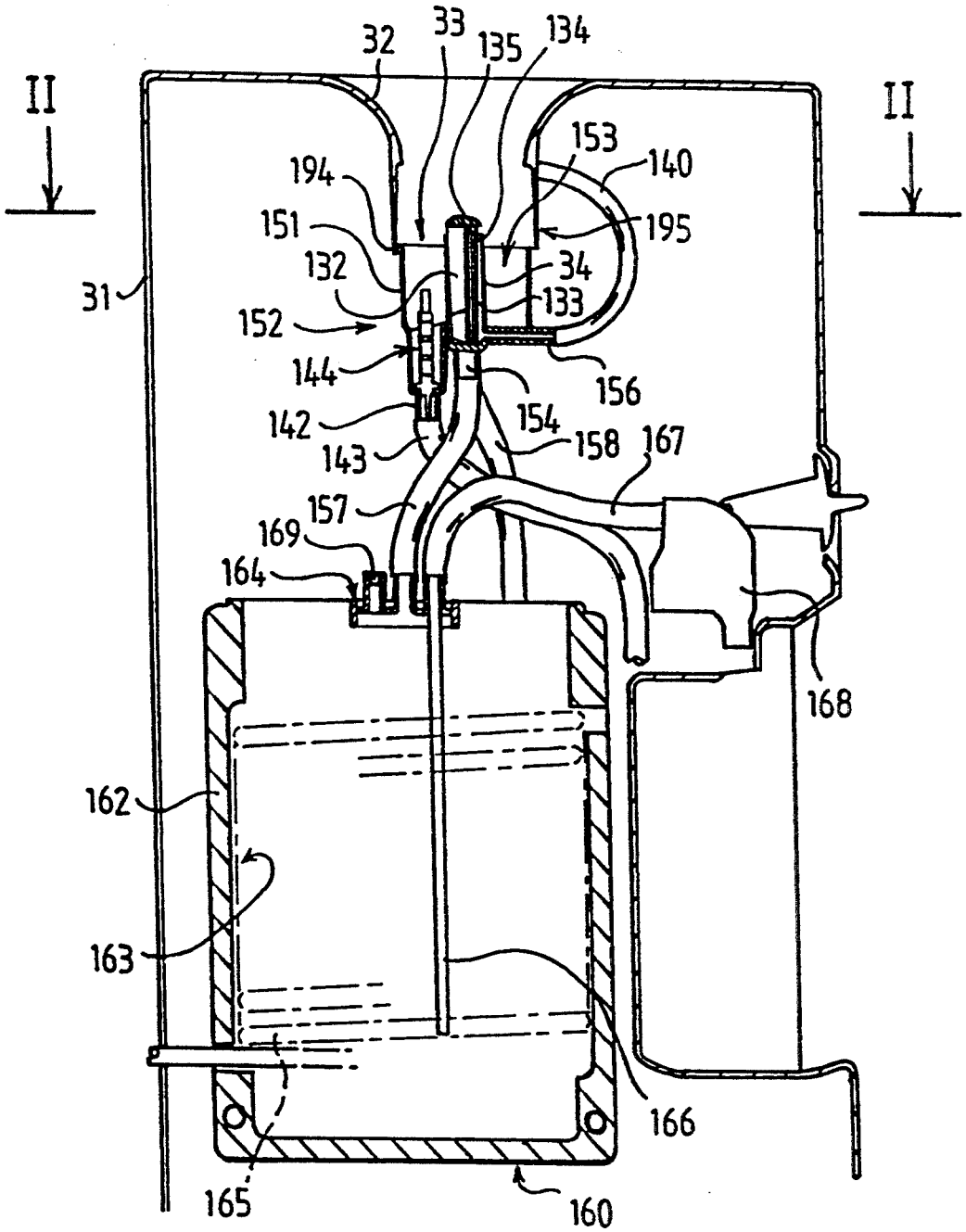
FIG. 1 is a vertical front-rear section through a water dispenser of the invention.

Referring firstly to FIG. 1, the dispenser includes a housing 31 which defines a generally funnel-shaped mounting portion 32 in its top wall for receiving and supporting a conventional inverted water bottle (not shown). The mounting portion 32 leads downwardly to a central circular opening 33 for receiving a capped neck of the bottle, and a feed tube 34 projects axially upwards through the centre of the opening 33, to pass sealably through the cap.

The feed tube 34 forms part of an injection moulded plastics manifold body 152. The feed tube projects coaxially within an integral outer cup portion 151 to define an annular collecting channel 153. The feed tube 34 is longitudinally divided into two axially extending passages 132 and 133 by an internal dividing wall 134. The dividing wall projects beyond the upper end of the feed tube to support a shield 135 which prevents entry of dirt and debris into the feed tube. Water from the bottle passes into the feed tube and travels along one of the passages 132 to a twinned pair of connecting nipples 154 formed on the bottom of the manifold, only one of which is visible in FIG. 1.

Figure 2:
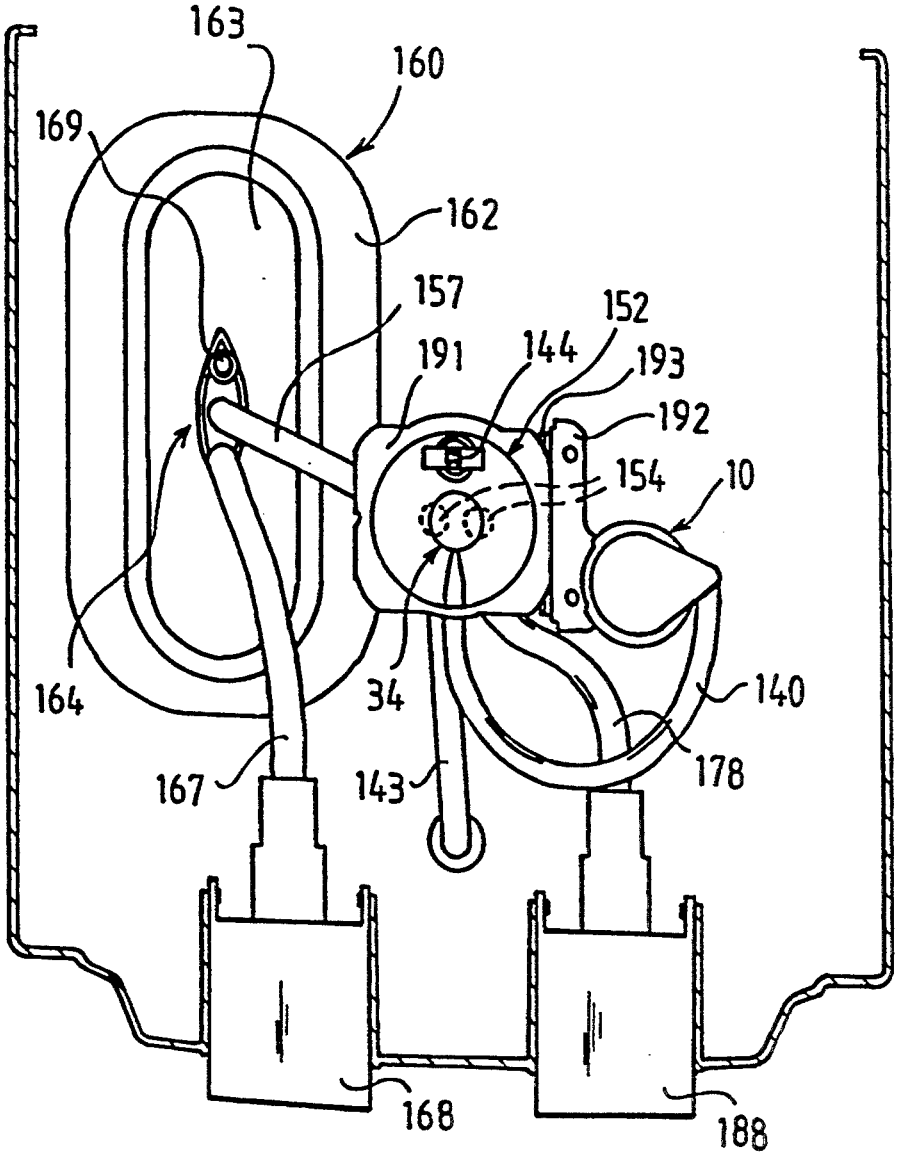
FIG. 2 is horizontal section II—II of FIG. 1 showing part of the dispenser in plan view.

A vent inlet 156 projects radially from the lower end of the feed tube 34 in communication with the second passage 133. Air is taken in through a valve and filter unit 10 (FIG. 2) which removes dirt and bacteria, and includes a one-way check valve to prevent water from escaping through the filter. The valve may be removably mounted in any convenient position. A blow-out valve may also be incorporated to release any pressure built-up in the water system. Clean air travels from the filter 10 to the vent inlet 156 via a length of flexible plastics or rubber tubing 140, and then travels along the second passage 133 into the bottle to replace discharged water.

The bottom of the cup 151 is provided with a third connecting nipple 142 to couple with a further length of flexible plastics or rubber tubing 143 for conducting any spillage water from the collecting channel 153 to waste. Occasionally the user may fail to seat a new bottle correctly on the feed tube, resulting in a slow leak. In order to prevent a significant proportion of the clean water being lost over a prolonged period, the connecting nipple 142 may incorporate a check valve 144 as shown. The check valve is normally open to conduct spillage to waste, but when the capped neck of the bottle is received within the cup 151 it operates the check valve 144 causing it to close. The side of the cup 151 forms a secondary seal with the neck of the bottle so that once the bottle is engaged water cannot leave the collecting channel 153. When the empty bottle is removed however, the valve 144 reopens to permit drainage of the channel 153.

The manifold is releasably mounted in the housing 31 in any convenient manner. In the illustrated example the upper end of the cup 151 has a generally rectangular external flange 191 (FIG. 2) which slides between a pair of opposed mounting brackets 192 (only one being shown), supported on runners 193 which project inwardly from the mounting brackets. The flange 191 abuts a depending stop 194 (FIG. 1) on the lower end of the funnel portion 32, and a cutout 195 is provided opposite the stop 194 for the feed tube 34 to pass through.

One of the two connecting nipples 154 is connected to a length of flexible plastics or rubber tubing 157 to feed water to a chilled water reservoir assembly 160. An open topped case 162 of expanded polypropylene or other heat insulation material contains a flexible plastics reservoir bag 163 having a moulded mouth fitting 164 to which the tube 157 is coupled. A cooling coil 165 is recessed into the side wall of the case 162 so that the bag 163 closely conforms to the shape of the coil when filled with water. Water enters the top of the bag from the fitting 164, and an outlet tube 166 projects from the fitting to the bottom of the bag to feed cooled water via a further length of plastics or rubber tubing 167 to a manually operable discharge valve 168, which is described in detail below. The fitting 164 also has a further connection point 169 which may be blanked off as shown or used to vent the bag to a suitable level.

Figure 3:
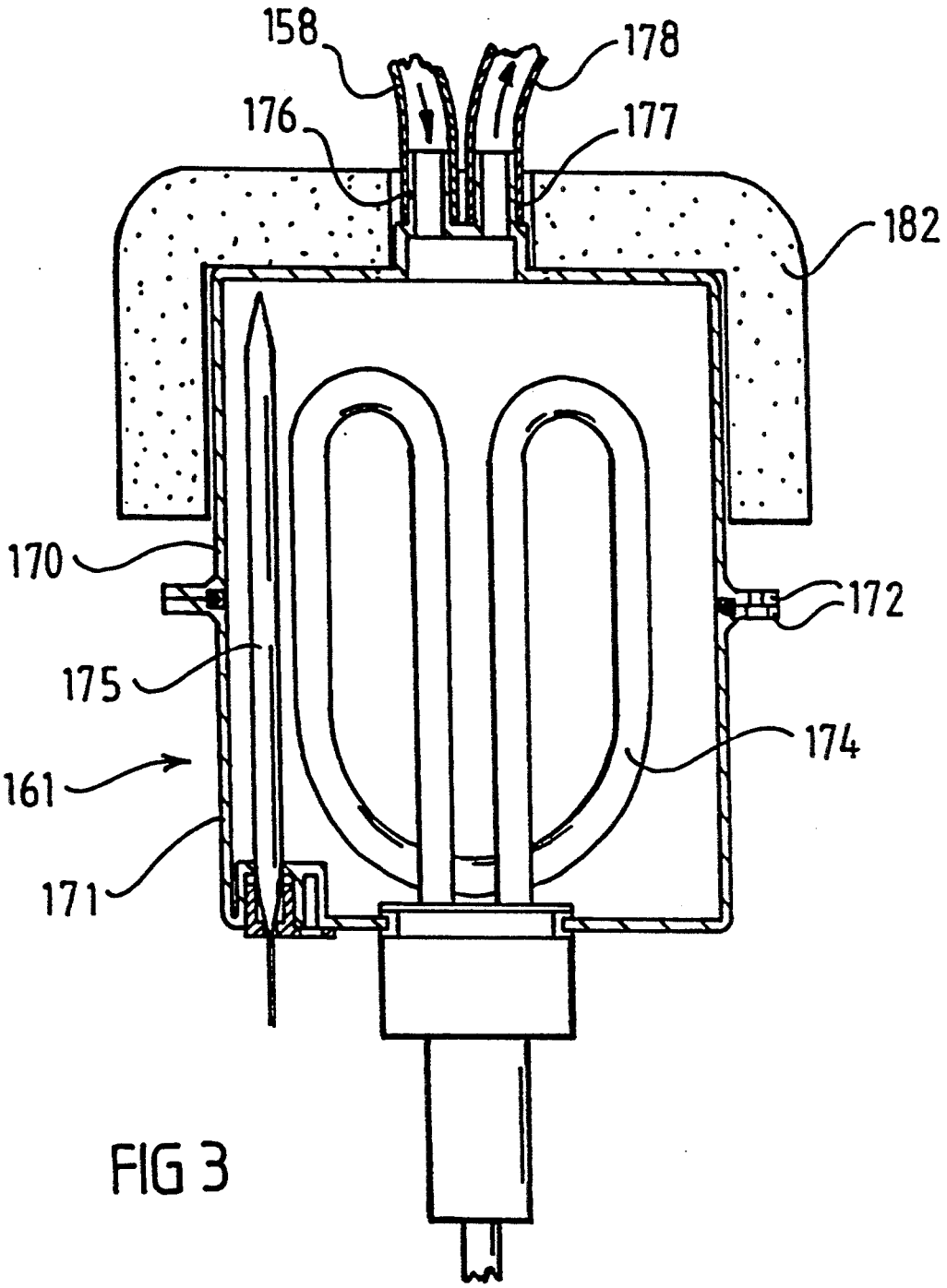
FIG. 3 is a vertical section through a hot water reservoir included in the dispenser.

The second connecting nipple 154 may be blanked off or it may lead via a respective length of flexible plastics or rubber tubing 158 directly to a second discharge valve 188 (FIG. 2) for dispensing water at ambient temperature. Valve 188 is of similar construction to the cold discharge valve 168, and the structure of these valves is described below. The tube 158 may also lead to the valve 188 via a carbonator for example. In the present example, the tubing 158 leads to a hot water reservoir 161, which is shown in FIG. 3. The hot reservoir is formed in two injection moulded parts 170 and 171 which are sealably joined at flanges 172 by suitable releasable fasteners. The reservoir contains a heating element 174 and a temperature probe 175 for thermostatic control of the heating element, both of which are sealably inserted through the bottom of the reservoir. Water from the tube 158 enters a connecting nipple 176 at the top of the reservoir, and hot water leaves via an adjacent nipple 177 to pass via flexible plastics or rubber tubing 178 to the second discharge valve 188. The top of the hot reservoir may also be vented to an appropriate level if required. The upper portion of the reservoir is enclosed within an outer casing 182 of expanded polypropylene or the like, for heat retention.

At this point it is to be noted that although a water dispenser having two water reservoirs has been described, the dispenser could equally have only one reservoir or more than two reservoirs. Similarly, the water in the reservoir is not necessarily heated or cooled.

Figure 4:
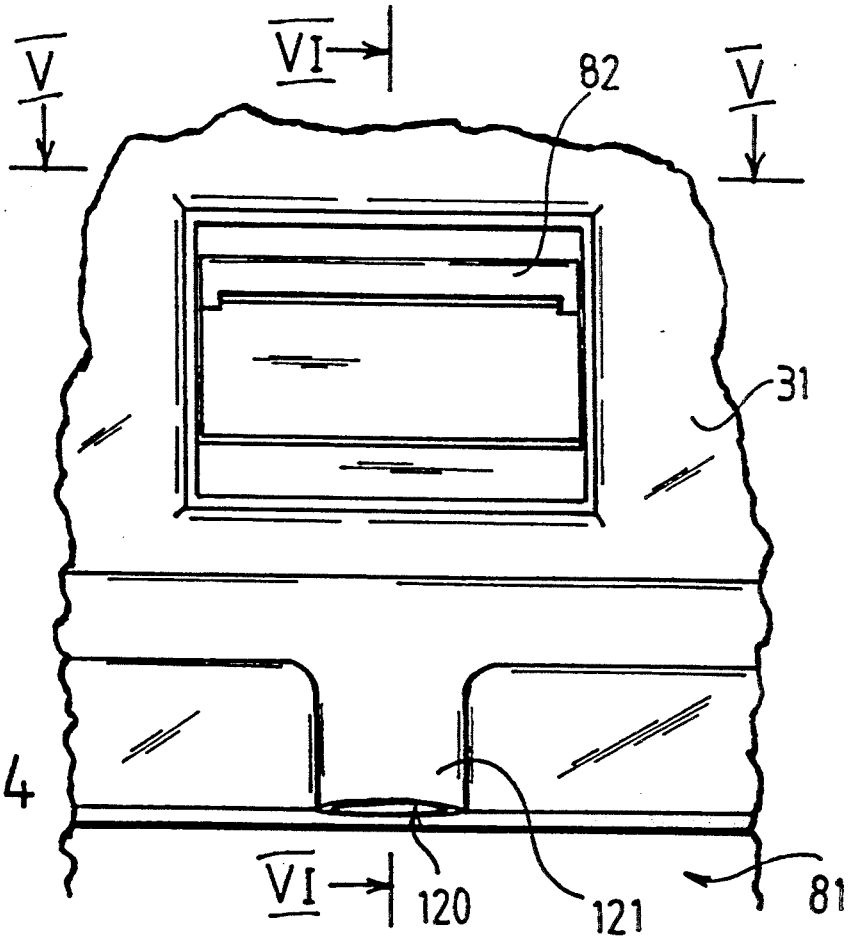
FIG. 4 is a front view of one of the water discharge valves included in the dispenser.
Figure 5:
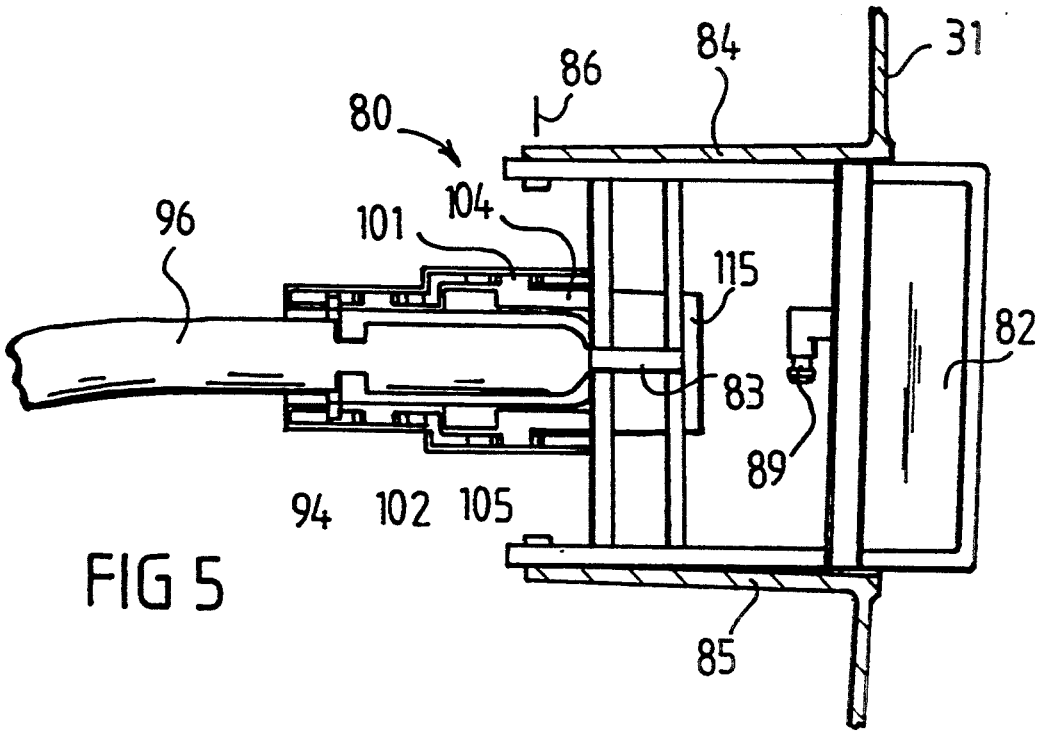
FIG. 5 is a plan view of the valve on section V—V of FIG. 4.

As noted above, the discharge valves 168 and 188 are of similar construction, and one of these valves will now be described with reference to FIGS. 4 to 6. Referring to these figures, the discharge valve 80 is mounted above a recess 81 formed in a front wall of the housing 31. An operating lever 82 projects through the front wall of the housing and is mounted between rearwardly extending arms 84, 85 (FIG. 2) to pivot about a generally horizontal axis 86 lying parallel to the front wall. The lever 82 is biassed upwardly by a tension spring 88 which acts between a lug 89 on the lever and a suitable projection 90 on the inside of the housing.

Figure 6:
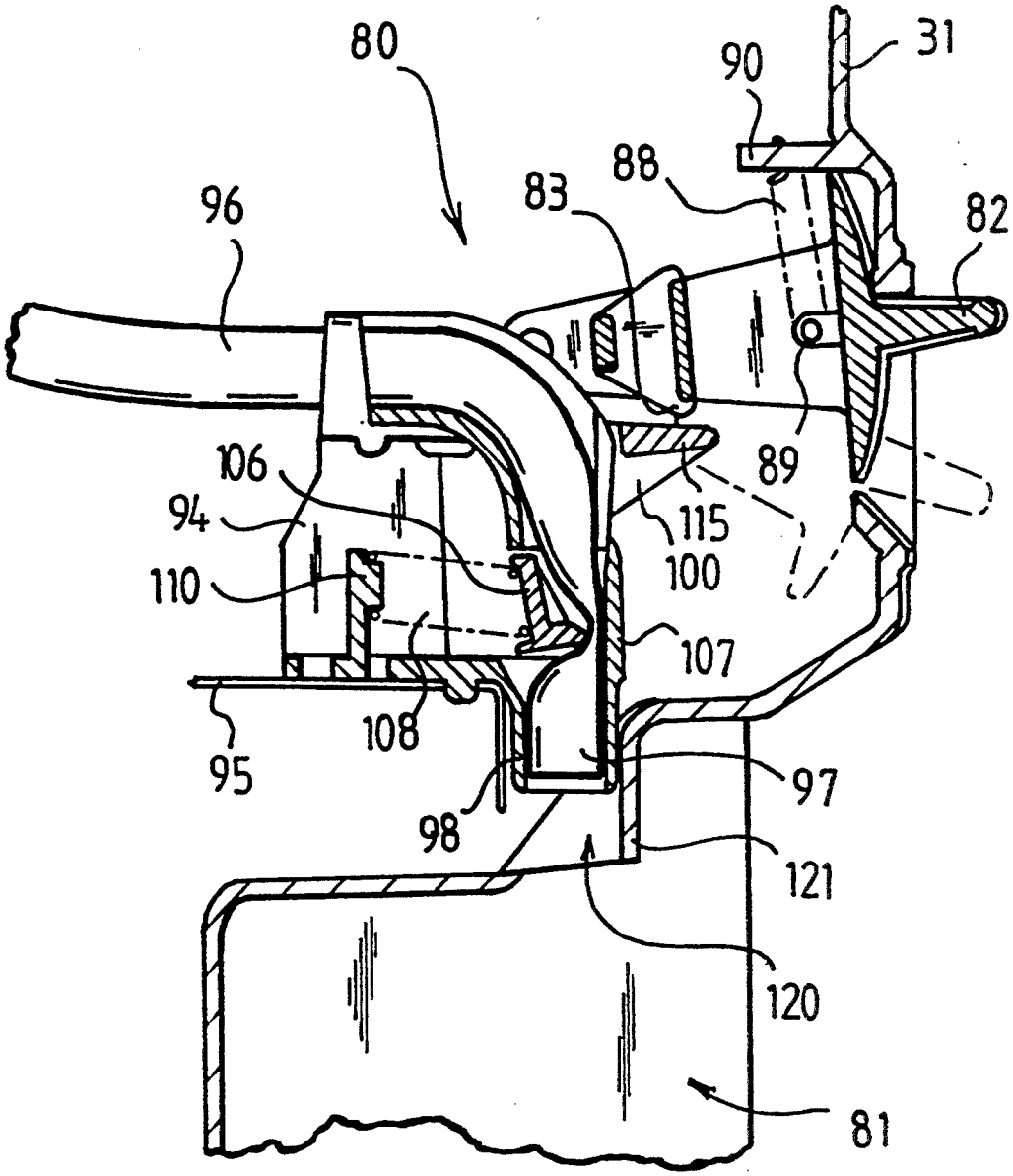
FIG. 6 is a vertical section VI—VI through the valve of FIG. 4.

Referring particularly to FIG. 6, a valve body 94 is mounted on a support plate 95 beneath the rear end of the lever 82. The valve body is shaped to closely receive a portion of flexible plastics or rubber tube 96, formed by the final section of the tubing 178 or 167 which leads from the respective hot or cold reservoir, such that the end portion 97 of the tube extends vertically downwards to terminate within a cylindrical outlet 98 formed integrally with the valve body. A pinch member 100 is pivotally mounted on pins 101, 102 within the valve body to move about an axis which is substantially parallel to the pivot axis 86 of the operating lever 82. The pinch member includes side cheeks 104 and 105 which are disposed on opposite sides of the tube 96 and which are joined by a pinch bar 106. This pinch bar bears against the rear of the vertical portion 97 of the tube under the action of a compression spring 108, acting between the rear of the bar 106 and an abutment 110 on the valve body, such that the tube 96 is nipped between the pinch bar 106 and an upper extension 107 of the outlet 98. The spring 108 is of sufficient strength to completely close off the tube 96 and prevent passage of water.

A further bar 115 joins the cheeks 104 and 105 in front of the vertical tube portion 97 and is positioned such that when it is required to dispense water, downward movement of the lever 82 against the action of spring 88 causes a nose 83 on the lever 82 to bear against the bar 115. This causes the pinch member 100 to pivot clockwise, as shown, further compressing the spring 108 and releasing the nip of the pinch bar 106 on the tube 96. Water can therefore flow through the tube.

It will further be noted in the drawings that the outlet 98 is disposed above an opening 120 formed in the housing 31, in the top wall of the recess 81. Furthermore, the outlet 98 is completely enclosed behind a forward deformation 121 of the housing 31, so that there is minimal risk of accidental contact between the hands of a user and the outlet end of the tube 96.

During maintenance, the manifold body 152 is removed together with the plastics or rubber tubing and the hot reservoir 161. The bag 163 is also removed from the outer case 162 of the cold reservoir, which remains in situ. Since the discharge valves 168 and 188 are in the form of pinch valves which operate on the respective tubing 167 and 178, the respective operating lever 82 is moved downwards to release the nip of pinch bar 106 on the tube 96 portion, which is then drawn out of the valve body and removed. The removed items are then replaced by clean ones. Those items which have been removed can either be sterilised for re-use (particularly the hot reservoir 161) or discarded. The clean lengths of tubing 167 and 178 can be fed through the respective valve body 94 with gentle pressure, whereupon the lever 82 is released to grip the tube.

The parts of the dispenser which have direct contact with the water are thus quickly replaced with clean components.

Figure 7:
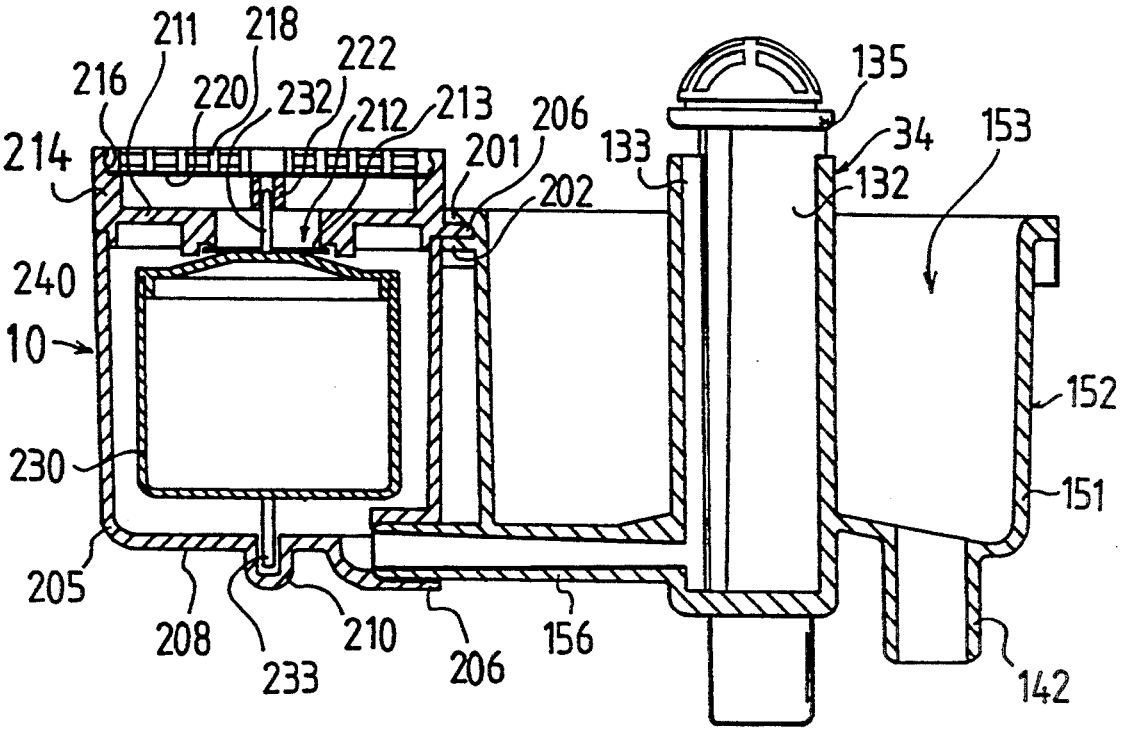
FIG. 7 is a vertical section through a modified manifold body, check valve and air filter of the dispenser.

FIG. 7 shows a modified form of the vent valve and air filter 10, which is now mounted on the side of the manifold body 152 to simplify replacement. Parts of the manifold body which correspond to that shown in FIGS. 1 and 2 have been given similar references. The outer cup wall 151 is formed with a pair of horizontal projecting ribs 201 and 202, positioned one above the other, and located immediately above the vent inlet 156. The vent valve unit includes an upright, generally cup-shaped housing 205, the interior of which communicates with an outlet spigot 206 which projects radially from the bottom of the housing to receive and connect with the vent inlet 156. The upper part of the housing is supported by a lateral projection 206 which is engaged between the ribs 201 and 202, either by a mechanical engagement or by heat welding or use of a suitable plastics adhesive for example.

The housing 205 incorporates a bottom wall 208 containing a centrally disposed guide socket 210, formed by a downward extension of the bottom wall 208. The housing is also provided with a top wall 211 having a central opening 212 surrounded on its lower margin by a valve seat 213. The top wall 211 is also formed with an upstanding annular wall 214 which is internally recessed at 216 to receive a circular grille 218. A filter element 220 for dirt and bacteria is entrapped between the lower surface of the grille 218 and the recess 216 to completely cover the apertures in the grille 218. In addition, the grille carries a central, downwardly projecting guide socket 222, located immediately above the opening 212.

A closed, generally cylindrical float 230 is received within the cup-shaped housing 205 and is guided for vertical movement therein by projecting axial pins 232 and 233, which are slidably received in the top and bottom guide sockets 222 and 210 respectively. The float carries a rubber disc valve element 240 which surrounds the pin 232 to co-operate with the valve seat 213 formed by the top wall 211.

When the bottle is engaged with the feed tube 34, pressure of water in the bottle causes an initial flow along vent passage 133 and vent inlet 156 into the check valve housing 205. This, in turn, causes the float 230 to rise until the valve element 240 sealably engages the seat 213 and prevents further flow of water into the valve housing. When water is drawn off via one of the discharge valves 168 or 188, the decreased pressure in the bottle will allow air pressure acting through the grille 218 and opening 212 to move the valve element away from its seat 213, permitting clean air to flow into the bottle via the housing 205 and passages 156 and 133. A similar flow of air into the bottle is caused by decreased pressure in the bottle due to cooling of any air therein, particularly when the water level in the bottle is getting low and the volume of air in the bottle is therefore high.

It will be appreciated that the cold reservoir bag 162 could take the form of a semi-rigid disposable container if desired. Also, the hot reservoir 161 could again be formed with a low-cost disposable inner lining (semi-rigid or flexible) which is in intimate heat-exchange contact with an external heating element of a fixed outer casing.

We claim:

1. Liquid dispensing apparatus for dispensing liquid from an inverted container having a neck through which the liquid is discharged, the apparatus comprising:

a housing provided with a mounting arrangement for receiving and supporting an inverted container thereon, said mounting arrangement defining an opening for receiving the container neck;

a body which includes a feed tube for insertion into the neck of the liquid container to conduct liquid therefrom;

mounting means within said housing for releasably holding said body, said mounting means being arranged to positively support said body within said housing and below said opening such that said feed tube projects upwardly to a level adjacent said opening for being received in the neck of the container, said body being releasably held by said mounting means;

conduit means connected for conducting liquid from said feed tube, said conduit means comprising a flexible tube; and a discharge valve for controlling the discharge of water from the container, the discharge valve comprising a pinch valve which is arranged to act on said flexible tube, said body and conduit means including said flexible tube thereby being removable for replacement during a maintenance operation whilst said pinch valve remains in situ.

2. Apparatus according to claim 1, wherein said feed tube includes a pathway for returning air to said container to replace liquid discharged therefrom, and said body includes an air inlet connected to said pathway.

3. Apparatus according to claim 2, wherein said air inlet is connected to a one-way check valve arranged to allow air to enter said air inlet to the container but which prevents liquid from flowing in the opposite direction through said inlet.

4. Apparatus according to claim 3, wherein said check valve is operated by a float.

5. Apparatus according to claim 3, wherein said check valve is connected to and supported by said body for removal therewith.

6. Apparatus according to claim 3, wherein said check valve incorporates an air filter.

7. Apparatus according to claim 1, wherein said flexible tube terminates in a discharge outlet, and the apparatus further comprises cover means which shrouds said discharge outlet.

* * * * *